US011371253B2

(12) United States Patent
Heller et al.

(10) Patent No.: US 11,371,253 B2
(45) Date of Patent: Jun. 28, 2022

(54) MIKVAH SANITATION DEVICES

(71) Applicant: Pool Purity Ltd, Jerusalem (IL)

(72) Inventors: Jonathan Jacob Heller, Jerusalem (IL); Tomer Jay Levy, Bet Shemesh (IL)

(73) Assignee: Pool Purity Ltd., Jerusalem (IL)

( * ) Notice: Subject to any disclaimer, the term of this patent is extended or adjusted under 35 U.S.C. 154(b) by 0 days.

(21) Appl. No.: 16/933,046

(22) Filed: Jul. 20, 2020

(65) Prior Publication Data

US 2021/0017781 A1 Jan. 21, 2021

Related U.S. Application Data

(60) Provisional application No. 62/876,650, filed on Jul. 20, 2019.

(51) Int. Cl.
*E04H 4/12* (2006.01)

(52) U.S. Cl.
CPC ..... *E04H 4/1263* (2013.01); *E04H 4/1272* (2013.01); *E04H 4/1218* (2013.01)

(58) Field of Classification Search
CPC ..... E04H 4/1263
USPC ..... 4/490, 488, 492; 15/1.7; 210/167.1–2; 134/167
See application file for complete search history.

(56) References Cited

U.S. PATENT DOCUMENTS

| | | | | |
|---|---|---|---|---|
| 8,844,304 | B2 * | 9/2014 | Peretz | F24F 5/0071 62/238.6 |
| 9,693,647 | B2 * | 7/2017 | Ebenspanger | E04B 1/66 |
| 2003/0024862 | A1 | 2/2003 | Gal | |
| 2011/0277488 | A1 * | 11/2011 | Peretz | F25B 30/02 62/79 |

FOREIGN PATENT DOCUMENTS

| | | |
|---|---|---|
| EP | 3 382 126 | 10/2018 |
| EP | 3 832 053 | 6/2021 |
| IL | 129333 | 3/2003 |

OTHER PUBLICATIONS

Meir Posen (editor), "Sefer Or Meir al Hilchot Mikvaot," Kiryat Sefer, Modi'in Illit, Israel, 2005-2006 (years).

* cited by examiner

*Primary Examiner* — Lori L Baker
(74) *Attorney, Agent, or Firm* — The Law Office of Joseph L.Felber

(57) ABSTRACT

A sanitation device for cleaning a body of water in an immersion pool of a mikvah has a hollow member that extends along an axis X. In an operative position suitable for cleaning the device is arranged to extend generally immersed in the water and in a general upright orientation. The device further has an upper opening that in the operative position is arranged to be generally flush with the upper surface of the water and a propeller arranged to rotate about axis X and located at a lower region of the device that is arranged to form a downward flow that urges water to enter the device via the upper opening of the device.

20 Claims, 8 Drawing Sheets

MIKVAH SANITATION DEVICES

TECHNICAL FIELD

Embodiments of the invention relate to mikvah sanitation devices, in particular for improving sanitation conditions in a body of water of a mikvah in which believers bathe to achieve ritual purity.

BACKGROUND

Classical rabbinical literature dictates many rules relating to the construction of a mikvah (or mikveh). For example, a mikvah has to be connected to a source of naturally occurring water, it must contain sufficient water to cover the entire body of an average-sized person; and the required volume of water should be about 40 seah.

Additional requirements dictate the manner in which the water can be stored and transported to or within the mikvah. For example it is forbidden for the water to pass through any vessel which could hold water within it. If however a vessel has an 'opening' that is large enough to fulfill a criteria called 'mouthpiece of a drinking pouch' (shfoferes hanod)—then the vessel may be used for filling or channeling water in a mikvah.

The booklet "Understanding Mikvah: An Overview of Mikvah Construction" by the author 'Rabbi Schneur Zaiman Lesches'; ISBN 0-9689146-0-8 (2001); specifies many of the requirement relating to a Mikvah. It specifies, inter alia, at pages 43 and in particular 44 and footnotes 67, 72 and 73 that an 'opening' in a vessel that qualifies as a 'mouthpiece of a drinking pouch' should be large enough for two average fingers to fit in and rotate.

The booklet further details that the dimension of such an 'opening' equals to a quarter of a tefach (the common measure for one tefach as used in modern mikvah's is 10 centimeters); and thus according to this measurement such an 'opening' could be as small as about 25 millimeters in width (see footnotes 67 and 72). In an enhancement (hiddur) that goes beyond the formal demands of rabbinical law—an 'opening' qualifying as a 'mouthpiece of a drinking pouch' should be at least 48 millimeters in width (see footnote 73).

Rabbinical rules relating to the purity and hence cleanliness and sanitation of the body of water in a mikvah are strictly followed, and thus to avoid unfit water, the water in a mikvah can often be completely drained away and refilled from scratch resulting in large quantities of water that are wasted. In cases where water in the Mikvah is heated, re-filling a Mikvah with new water requires re-heating the water, a process that is wasteful in energy. Thus, being able to use the water in the mikvah for longer periods of time, while maintaining water cleanliness and the required purity of the water for its intended religious ritual, is advantageous.

SUMMARY

The following embodiments and aspects thereof are described and illustrated in conjunction with systems, tools and methods which are meant to be exemplary and illustrative, not limiting in scope.

In an embodiment there is provided a sanitation device for cleaning a body of water in an immersion pool of a mikvah, the device comprising a hollow member extending along an axis X that in an operative position suitable for cleaning is arranged to extend generally immersed in the water and in a general upright orientation, the device further comprising an upper opening that in the operative position is arranged to be generally flush with the upper surface of the water and a propeller arranged to rotate about axis X and located at a lower region of the device, wherein the propeller is arranged to form a downward flow through the hollow member that urges water to enter the device via the upper opening to be cleaned in the device and then released back into the body of water after flowing passed the propeller. This downward flow may be defined as sucking substances from the upper surface of the water in the Mikvah to be cleaned in the sanitation device.

In an embodiment, the sanitation device comprises a top float that is axially slidable with respect to the hollow member, the top float comprising the upper opening and having a buoyancy suitable for maintaining the upper opening generally flush with the upper surface of the water.

In an embodiment, the sanitation comprises a disposable non-woven filter media through which water flows after entering the device. Such non-woven filter has a generally lower likelihood of maintaining water within it thus complying with Rabbinical rules relating to a Mikvah.

In an embodiment, the sanitation device comprises a gap G that is formed between an outer edge of the revolving propeller and an inner face of a portion of the device housing the propeller, wherein gap G is arranged to fulfill a criteria of 'mouthpiece of a drinking pouch' (shfoferes hanod) by being generally equal to or greater than about 25 millimeters, and in an enhancement (hiddur) preferably generally equal to or greater than about 48 millimeters.

In addition to the exemplary aspects and embodiments described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1:
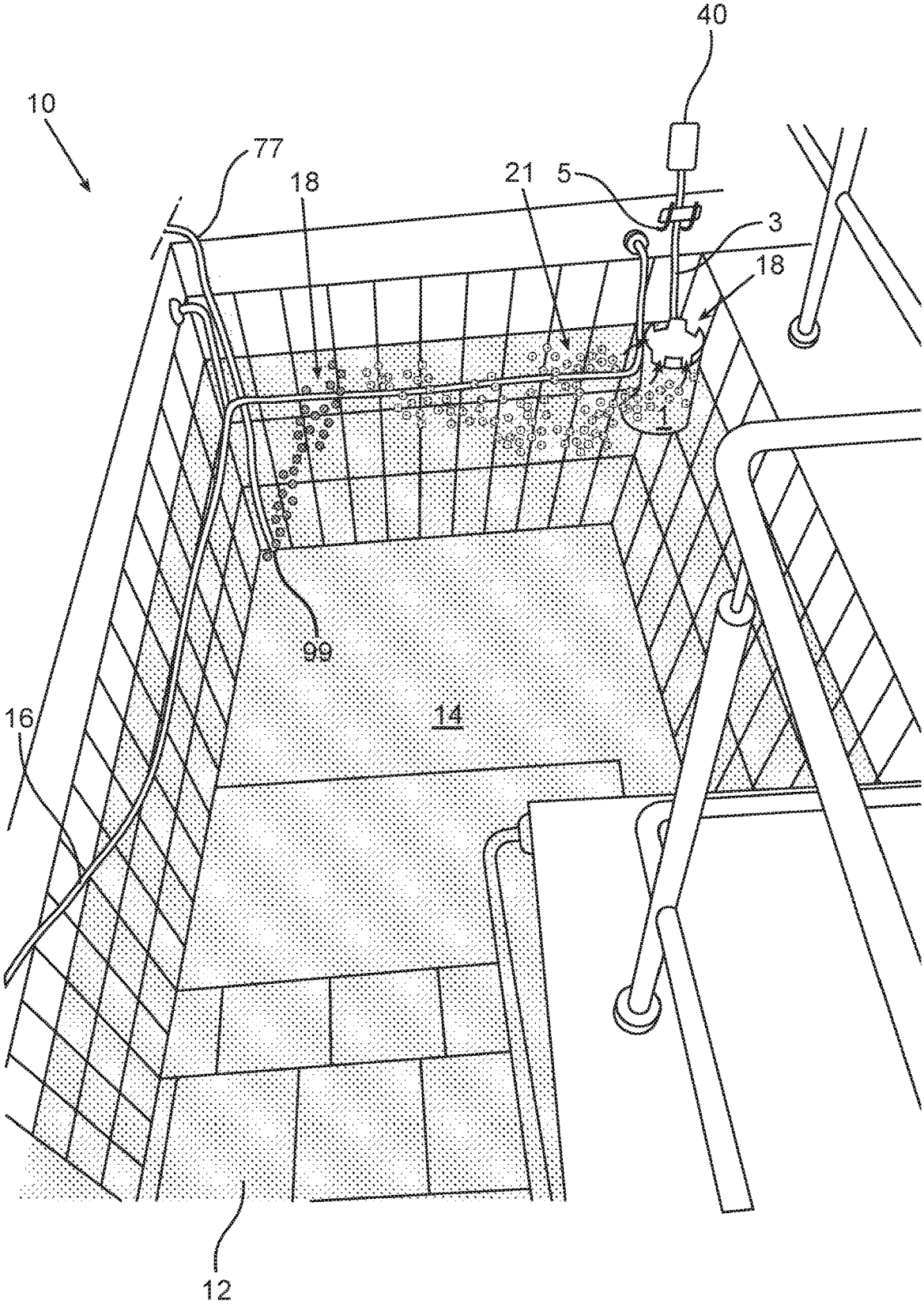
FIG. 1 schematically shows a top view of a mikvah in which believers bathe to achieve ritual purity and an embodiment of a sanitation device located in a body of water of the mikvah.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Attention is first drawn to FIG. 1 schematically illustrating a typical view of a modern type mikvah 10. Mikvah 10 may come in various shapes and typically includes steps 12 that lead down into an immersion pool that includes a body of water 14 where believers can bathe to achieve ritual purity. The mikvah may also include a banister 16 for supporting believers into and out of the immersion pool and for surrounding the immersion pool.

The mikvah of FIG. 1 is here shown including a sanitation device, in this example embodied as a skimmer 18. Skimmer 18 is designed to skim substances 21, such as oily floating substances, apoptosis floating materials (or the like); from the upper surface of the body of water. Skimmer 18 is light weight and includes a main portion 1 and a possible handle 3 that extends away from the main portion.

In some aspects of the present invention, sanitation devices (such as the skimmer embodiment or the filter embodiment later discussed) may be arranged to be utilized substantially in conjunction with additional system for treating a body water, such as those described in PCT WO2018002806, the disclosure of which is incorporated herein by reference, that describes a system for producing treating materials, here treated oxygen containing gas, suitable for treating a body of water.

Such systems for treating a body water typically break down dirt and organic matter within the water that may in turn result in increased formation of floating substances 21. These floating substances 21 may then accordingly be cleaned/collected from the upper surface of the water by the presently disclosed sanitation devices. In FIG. 1, a tube 77 that may be connected to an upstream device or generator (not shown) that produces treating materials (such oxygen containing gas) is shown entering the mikvah's immersion pool to form an ejection port 99 where treating materials 88 can be released into the immersion pool, here adjacent its floor.

In certain cases, floating substances 21 resulting from the release of such treating materials 88 may be urged to float upon the upper surface of the immersion pool in a direction away from ejection port 99. Therefore, sanitation devices according to the various embodiments of the present invention may possibly be located in the mikvah's immersion pool at a location that is relatively distant to ejection port 99 in order to be suitably located to receive the arriving floating substances 21.

For example, an embodiment of a sanitation device of the invention may be located at an adjacent and/or opposing corner of the immersion pool—as generally illustrated in FIG. 1. In certain cases, where an immersion pool cannot permit such distancing, resulting in the sanitation device and ejection port being relatively close—the operation of the sanitation device and an additional system may be timed to occur substantially one after the other—so that the two processes do not interfere.

It is noted that although hereinabove, embodiments of sanitation devices of the present invention have been exemplified functioning in conjunction with additional systems for treating a body of water—such sanitation devices are also suited to perform their cleaning actions alone or in conjunction with other type devices not mentioned. In addition it is noted that the sanitation device embodiments disclosed herein (when either operating alone or in conjunction with additional devices) may be arranged to operate in order to clean/purify the water of the Mikvah at times when the Mikvah is not in use so as to not interfere with the religious ritual. From hereon, the discussed sanitation device embodiments will be described in detail.

In the skimmer embodiment, handle 3 as seen in FIGS. 1 and 4 can be fitted at its upper side over a hook like member 5 that is attached e.g. to a side wall adjacent the immersion pool. Thus, skimmer 18 may be arranged to hang in an operative mode suitable for skimming the mikvah's body of water, with its main portion 1 extending generally upright and substantially immersed within the body of water.

Figure 2:
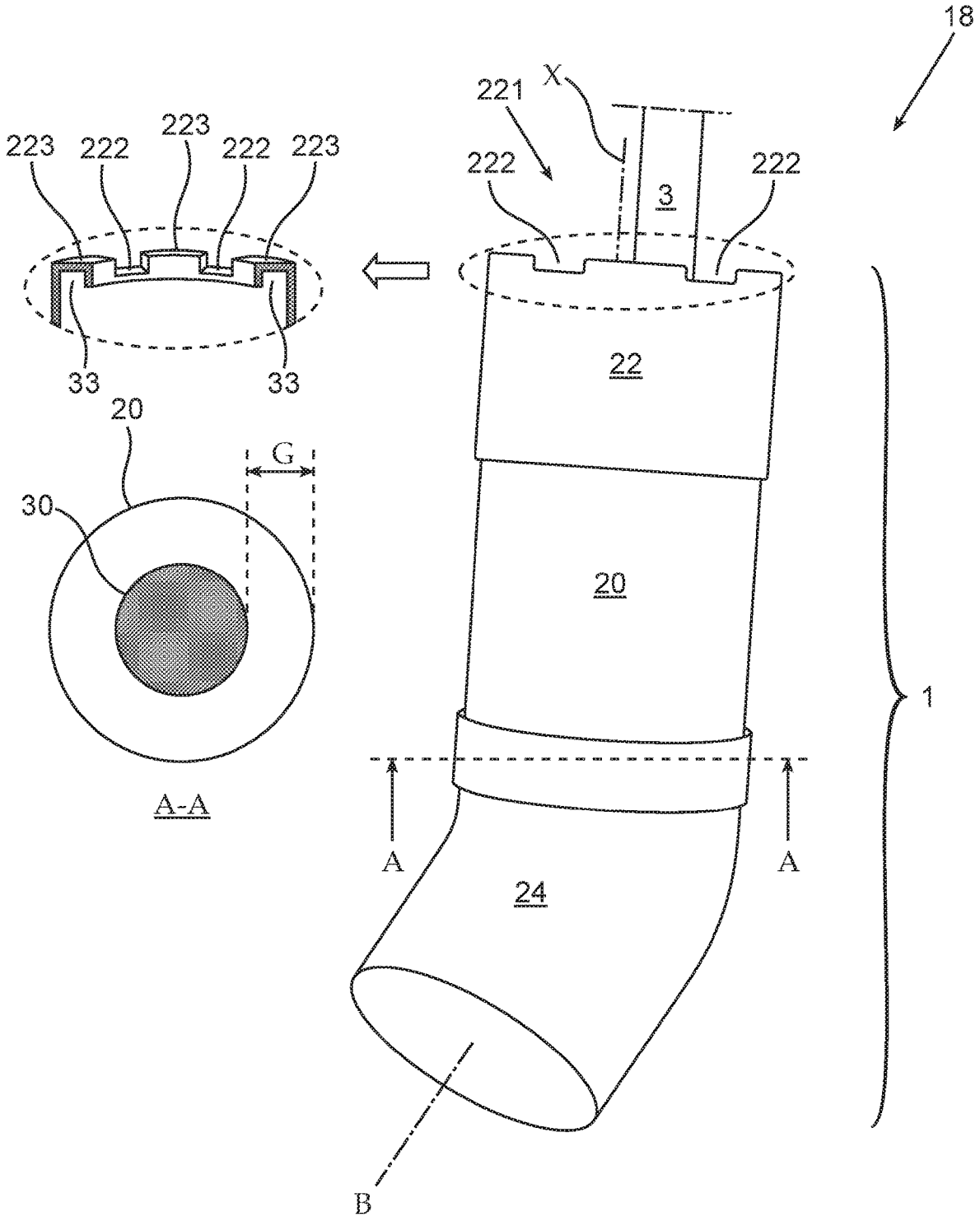
FIG. 2 schematically shows a side view of the sanitation device illustrated in FIG. 1, here embodied as a skimmer.

Attention is drawn to FIG. 2 for a closer view of the skimmer's main portion 1. Skimmer 18 as here seen includes an outer housing that has a hollow and generally cylindrical middle pipe 20 formed about an axis X, and a bottom pipe 24 that extends along an axis B that is here optionally angled by about 45 degrees (or the like) with respect to the middle pipe and axis X.

A top float 22 may be fitted to the outer housing so that it is axially slidable with respect to the middle pipe. Top float 22 is arranged to have a buoyancy that maintains its upper edge 221 just above and/or generally flush with the upper surface of the water. Upper edge has recess bays 222 formed therein defining bulges 223 between each pair of such recess bays 222. The recess bays 222 provide passageways for water to flow in between adjacent bulges 223 passed the upper edge and into the skimmer.

Attention is drawn to the upper left section in FIG. 2 illustrating a cross sectional view of an upper portion of a possible formation of top float 22 as taken in a plane including axis X. Top float 22 as seen in this embodiment is adapted to include a peripheral channel 33 that extends along a lower side of its upper edge 221. Air present within channel 33 during use of the skimmer is adapted to assist in buoyancy of top float 22 so that its upper edge 221 may be substantially maintained just above and/or generally flush with the upper surface of the water being skimmed.

Skimmer 18 may be fixed, e.g. at its middle pipe 20, to handle 3—and by that may be maintained fix in place within the water of the mikvah. In order to compensate for relative slight changes (e.g. of up to about 5 centimeters) in the level of water in the mikvah—top float 22 may be arranged to slide with respect to middle pipe 20. Therefore, if the water rises slightly (e.g. due to a bather entering the water) top float 22 can slide upwards in relation to middle pipe 20 to maintain upper edge 221 suitably located just above and/or generally flush with the upper surface of the water.

Figure 3:
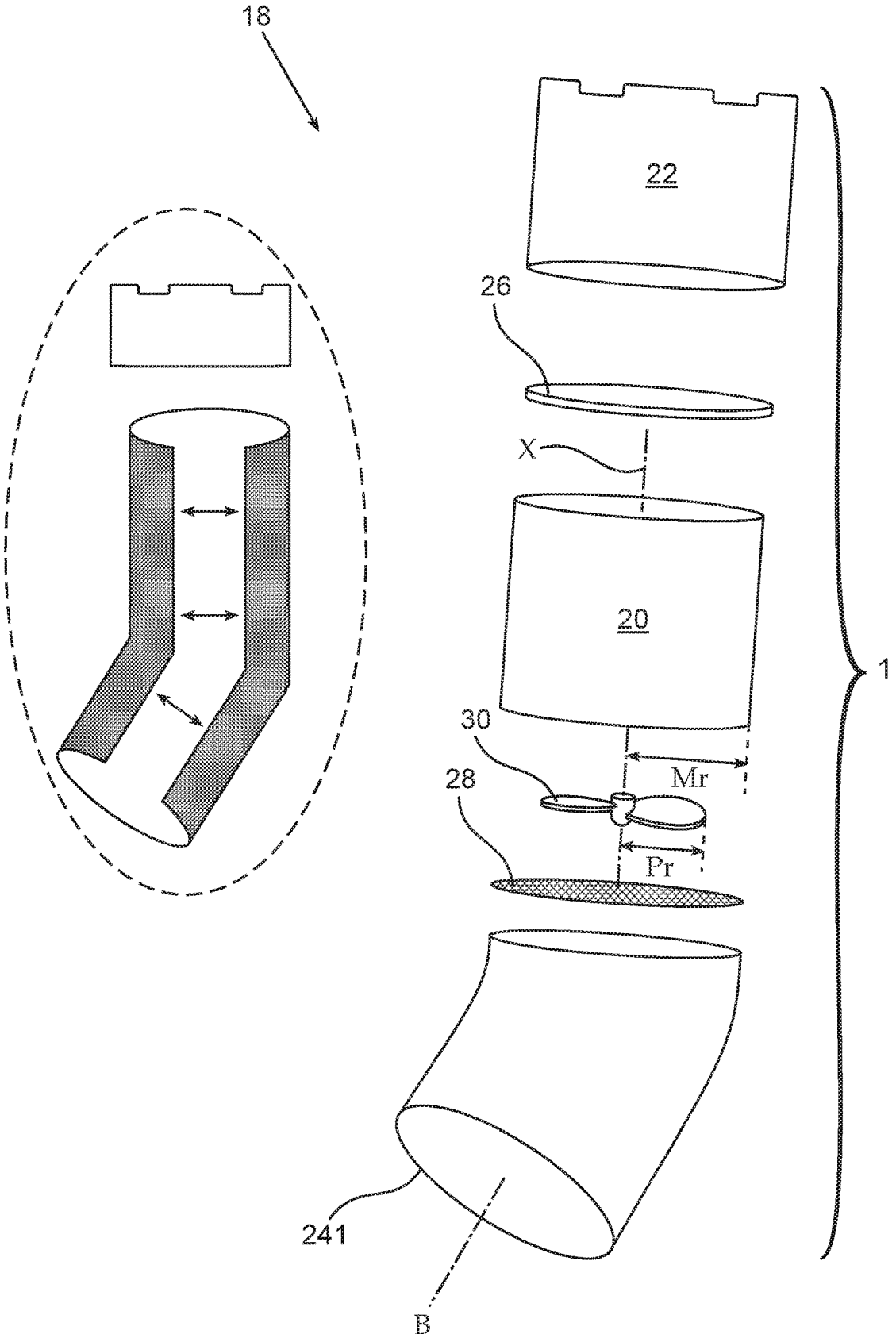
FIG. 3 schematically shows an exploded view of the skimmer of FIG. 2.

Attention is additionally drawn to the exploded view of FIG. 3 revealing further possible parts of the skimmer. Skimmer 18 can here be seen including at its main portion 1 a possible disposable filter media 26, an optional mesh screen protector 28 and a motorized propeller 30 that is located below the filter media 26 possibly adjacent a lower side of the middle pipe 20. Screen protector 28 may be arranged generally in-between the middle and bottom pipes 20, 24, respectively. In certain cases, screen protector 28 may be positioned in other areas of the skimmer, e.g., generally at the lower open end 241 of bottom pipe 24 (see discussed below) or the like. Propeller 30 may be arranged to be powered by a brushless motor that is fitted directly thereto and arranged to urge the propeller revolve about axis X.

Filter media 26 may be supported above middle pipe 20 and may preferably be formed from non-woven material. Provision of such non-woven material for filter media 26 is advantageous, inter alia, in providing a filer media that is not considered a piece of clothing according to Halakha (the collective body of Jewish religious laws derived from the written and Oral Torah). According to Halakha, water passing through woven material is considered as unfit for a mikvah, and thus by providing non-woven material for filter media 26, the water passing therethrough is deemed suitable for a mikvah. By making the filter media easily disposable, the skimmer meets additional sanitation criteria that make it suitable for a mikvah.

Propeller 30 may be arranged to receive its power from an electronic speed control (ESC) 40 here fitted to a wall outside of the water, possibly adjacent the hook like member 5. ESC 40 may be arranged to control and regulate the speed of the electric motor powering propeller 30. In various embodiments, ESC 40 may be arranged to control speed/RPM of the propeller, monitor and/or control temperature of the motor powering the propeller, direction of rotation of the motor and propeller, resistance of the thrust on motor (or the like). The ESC may be adjusted remotely to control the motor and function of the propeller.

A radius Pr is defined between an outer tip of propeller 30 and axis X; and a radius Mr is defined between an inner face of middle pipe 20 and axis X. A gap G equal to Mr minus Pr (G=Mr−Mp) is thus defined between an outer edge of a disc formed by the revolving propeller 30 and the inner face of middle pipe 20.

This gap G can be seen illustrated in cross section A-A provided at the upper left-hand side of FIG. 2.

In an embodiment, gap G is preferably sized to be at least about 25 millimeters (or more); and in an enhancement (hiddur) at least about 48 millimeters (or more)—in order to provide an 'opening' between the revolving propeller and the interior of middle pipe that fulfills the criteria of 'mouthpiece of a drinking pouch' (shfoferes hanod).

The propeller when powered to revolve—urges a downward directed flow of water through the skimmer 18, which in turn draws water from the upper surface of the body of water of the mikvah into the skimmer. The water entering the skimmer via the recess bays 222 flows passed filter media 26 where substances 21 drawn into the skimmer form the upper surface of the water can be caught. The water then flows passed the propeller (through the 'opening' defined by gap G) and onwards via the optional screen protector 28 to exit the skimmer back into the body of water of the mikvah at the lower open end 241 of bottom pipe 24.

The circled section at the left-hand side of FIG. 3 illustrates a possible formation that the outer housing of skimmer in certain embodiments may assume. In this example, the outer housing is shown formed from two halves that can be attached to each other to form an assembled state of the skimmer.

Figure 4A:
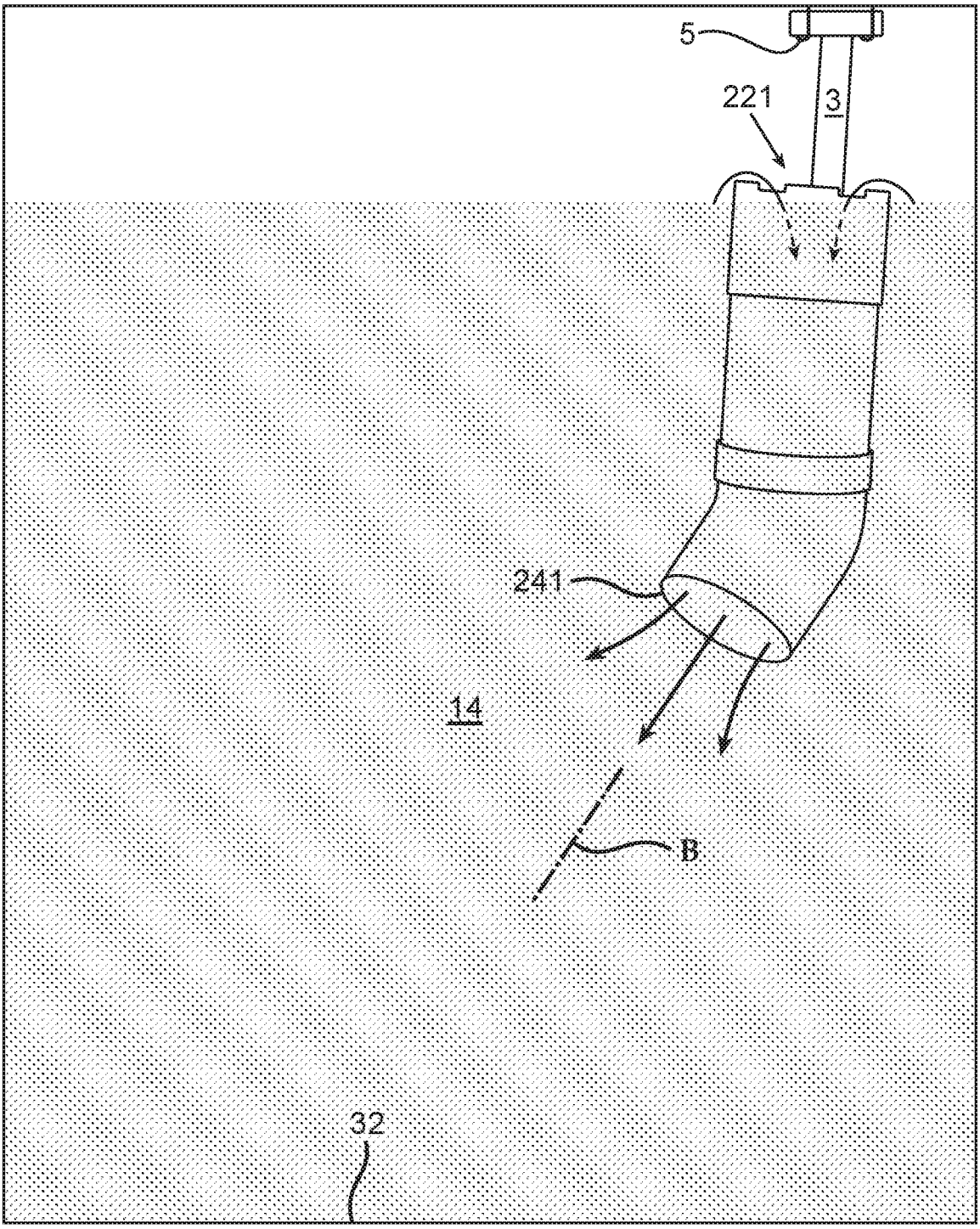
FIG. 4A schematically shows the skimmer of FIGS. 2 and 3 located in a body of water of a mikvah.

Attention is drawn to FIG. 4A illustrating the flow of water entering the skimmer via its upper edge 221 and then released back into the water of the mikvah via its lower open end 241. In cases where filters are not used for cleaning water in a mikvah due e.g. to halachik constraints, the substantially stagnant water of the mikvah when not in use may result in accumulation of dirt and/or organic matter in the water. In the various skimmer embodiments of the present invention, skimmed water released back via the lower open end 241 of the skimmer, may assist in increasing circulation of water in the mikvah's immersion pool and by that reduce formation of dirt and organic matter in the water. Skimmer embodiments including a lower open end 241 that extends along an axis B, which is slanted relative to floor 32 of the mikvah's immersion pool may increase such circulation.

Also shown in this figure is the releasable attachment of the skimmer via its handle 3 to the hook like member 5, which maintains the skimmer fixed in place within the water of the mikvah adjacent the upper surface of the water and spaced away from the floor 32 of the mikvah's immersion pool. Such releasable attachment of the skimmer may permit easy maintenance to the skimmer—e.g. replacement of disposable filter media 26 (or the like).

Figure 4B:
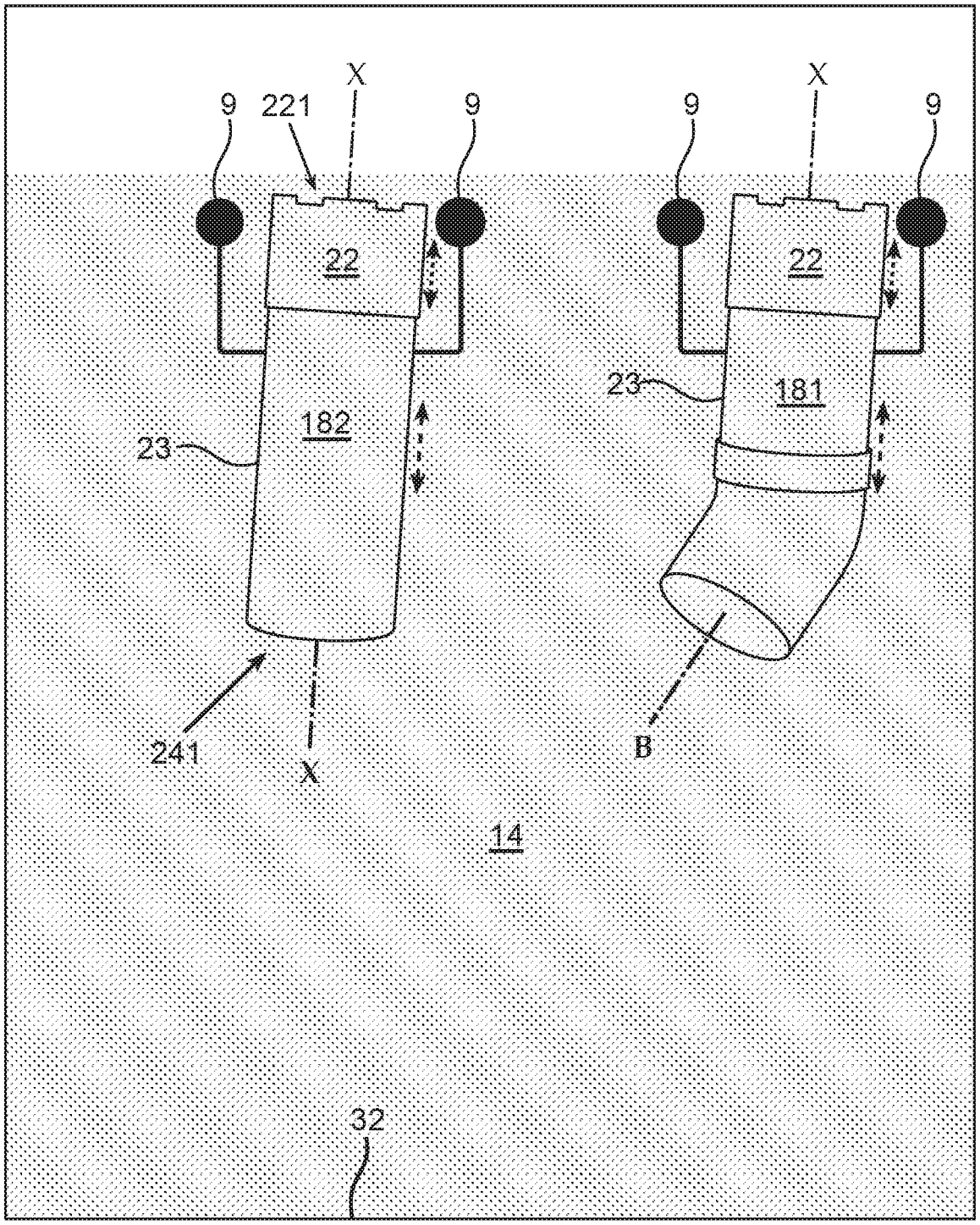
FIG. 4B schematically shows embodiments of skimmers generally similar to that in FIG. 4A.

FIG. 4B illustrates embodiments of two skimmers 181, 182 both generally similar to those shown in FIGS. 2, 3 & 4A—however here seen optionally not necessarily requiring connection to the wall of the immersion pool (as e.g. illustrated in FIGS. 1 and 2). Both these skimmers utilize flotation members 9 here is form of buoys that assist in flotation of the skimmers. Although two skimmers are here shown located in the same mikvah immersion pool, it is noted that also a single skimmer may be typically used for cleaning an immersion pool.

Skimmer 182 when placed in an operative state suitable for skimming the mikvah's body of water 14, can be seen including a main segment 23, here in form of a generally cylindrical pipe housing, that extends generally upright along an axis X of the skimmer all the way down from its upper edge 221 located just above and/or generally flush with the upper surface of the water to its lower open end 241.

Thus the lower open end 241 of skimmer 182 may open generally downwards as opposed to the lower open end 241 of the skimmers of FIGS. 2, 3 and 4A (and also skimmer 181 in FIG. 4B), which open generally transversely downwards along an axis B that is slanted relative to axis X and to the floor 32 of the mikvah's immersion pool. Skimmer 181 also has a main segment 23, here also in form of a cylindrical pipe housing, which is generally similar to those in the skimmer embodiments of FIGS. 2, 3, and 4A with a lower housing segment that extends transverse to axis X along axis B.

In each skimmer 181, 182, the flotation members 9 are adapted to attach to the main segment 23 of the skimmer leaving the skimmer's top float 22 free to axially move up and down relative to the main segment. Thus, while the flotation members 9 are adapted to maintain a rough flotation position of the skimmer (as illustrated by the 'dashed' arrows in FIG. 4B), the top float 22 in each one of these skimmers (see 'dotted' arrows in FIG. 4B) is adapted assist in obtaining a finer flotation position aimed at maintaining the skimmer's upper edge 221 just above and/or generally flush with the upper surface of the water.

In an embodiment of the present invention, such fine tuning of the location of the top float's upper surface 221 may be assisted to choosing a lighter material for top float 22 relative to remaining portions of the skimmer (e.g. its main segment). In addition or alternatively, the skimmer's top float 22 may assume a buoyancy that reacts faster to water height changes in the immersion pool by e.g. including a channel 33 formation similar to that shown in the upper left section of FIG. 2.

In an aspect of the present invention, skimmer embodiments may be removed from the mikvah's immersion pool prior to periods of time when believers enter to immerse in the immersion pool. Thus cleaning the water at times when believers do not immerse in the immersion pool may be advantageous in e.g. making the mikvah more aesthetically pleasing during ritual use, more mehudar by halacha, healthier because the bacteria and dirt removed from the water is not present in the water when bathers immerse (etc.).

Figure 5:
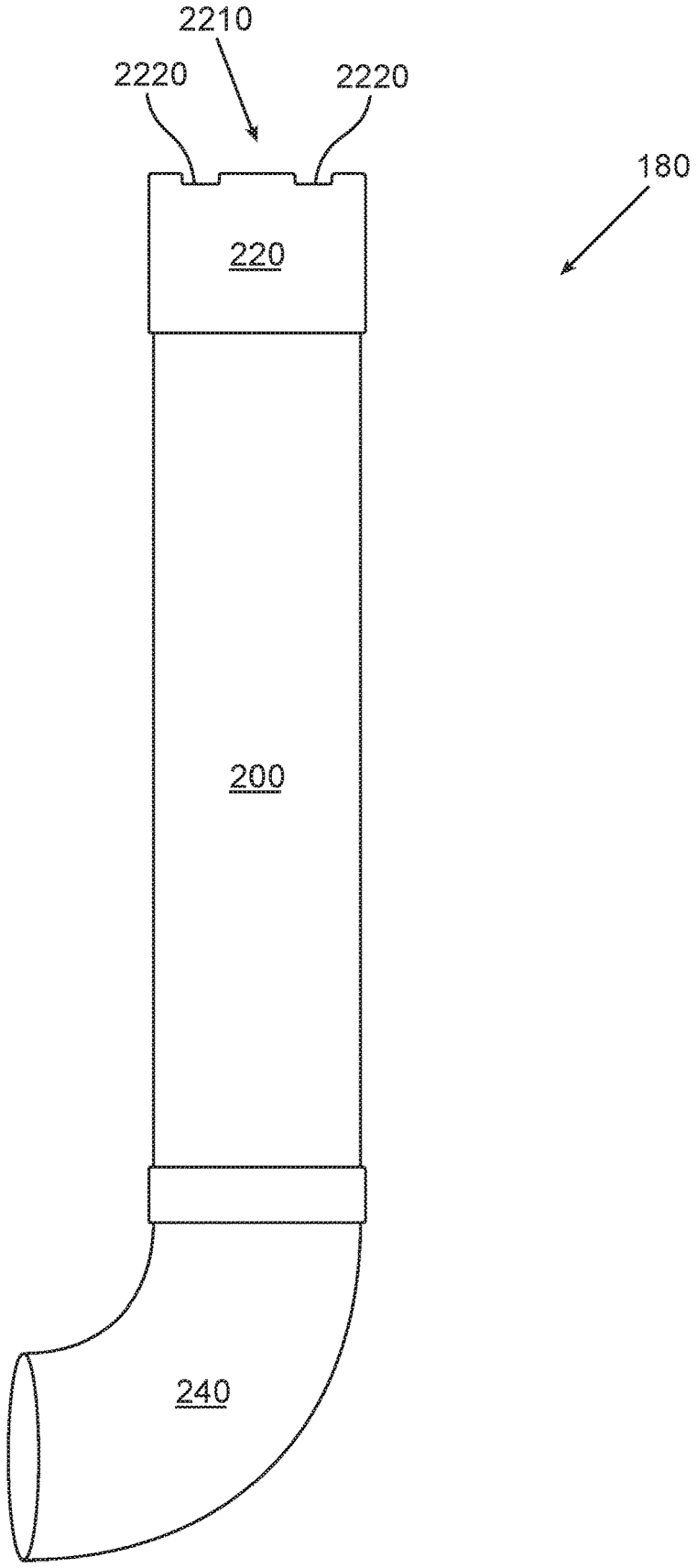
FIG. 5 schematically shows an embodiment of a sanitation device suitable for being located in the water of the mikvah, here embodied as a filter.

Attention is drawn to FIG. 5 illustrating another sanitation device here embodied as a filter 180. Filter 180 as here seen includes a generally cylindrical middle pipe 200 that is formed about an axis, a top float 220 that is axially slidable with respect to the middle pipe, and a bottom pipe 240 that is here optionally angled by about 90 degrees with respect to the middle pipe and its axis. Top float 220 is arranged to have a buoyancy that maintain its upper edge 2210 just above and/or generally flush with the upper surface of the water. Upper edge has recess bays 2220 formed therein to provide passageways for water to flow passed the upper edge and into the filter.

Filter 180 may be fixed e.g. at its bottom pipe 240 to the floor 32 of the mikvah's immersion pool e.g. via a support 55 (see FIG. 7)—and by that may be maintained fix in place within the water of the mikvah. Such fixing of the filter may be in a removable manner e.g. by arranging filter 180 to rest e.g. on such support 55 in order to hold it in place however without positively keeping it fixed to the floor (e.g. by screws, glue, etc.) thus allowing easy removal of the filter from the mikvah. In order to compensate for relative slight changes (e.g. of up to about 5 centimeters) in the level of water in the mikvah—top float 220 may be arranged to slide with respect to middle pipe 200. Therefore, if the water rises slightly (e.g. due to a bather entering the water) top float 220 can slide upwards in relation to middle pipe 200 to maintained upper edge 2210 suitably located just above and/or generally flush with the upper surface of the water.

Figure 6:
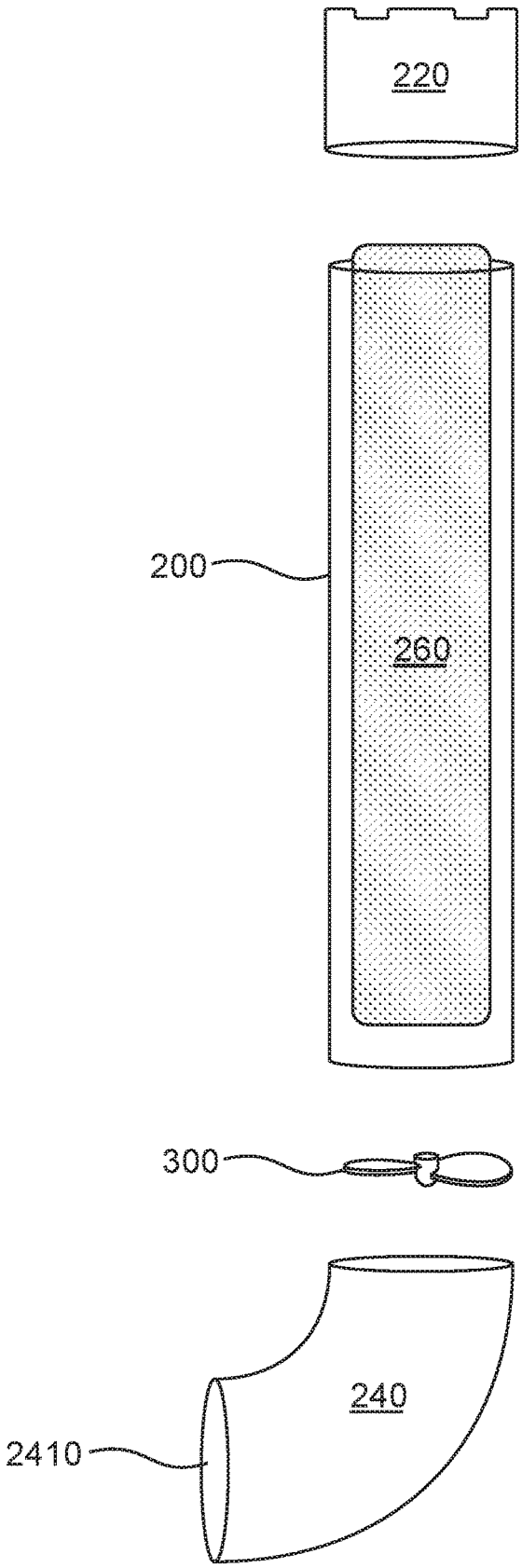
FIG. 6 schematically shows an exploded and partial cross sections view of the filter of FIG. 5.

Attention is drawn to the exploded view of FIG. 6 revealing further possible parts of the filter. Filter 180 can here be seen including a filter cartridge 260 located within and substantially along a full length of the middle pipe 200. Filter 180 in addition includes a motorized propeller 300 located below filter cartridge 260 that may be arranged to be powered by a brushless motor that is fitted directly thereto.

Propeller 300 may be arranged (as in the case of the skimmer) to receive its power from an electronic speed control (ESC) 40. ESC 40 may be arranged to control and regulate the speed of the electric motor powering propeller 300. In various embodiments, ESC 40 may be arranged to control speed/RPM of the propeller, monitor and/or control temperature of the motor powering the propeller, direction of rotation of the motor and propeller, resistance of the thrust on motor (or the like). The ESC may be adjusted remotely to control the motor and function of the propeller.

The propeller when powered to revolve—urges a downward directed flow of water through the filter 180, which in turn draws water from the upper surface of the body of water of the mikvah into the filter. The water entering the filter flows passed filter cartridge 260 where substances 21 drawn into the filter form the upper surface of the water can be caught. The water then flows passed the propeller to exit the filter back into the body of water of the mikvah at the lower open end 2410 of the bottom pipe 240.

Figure 7:
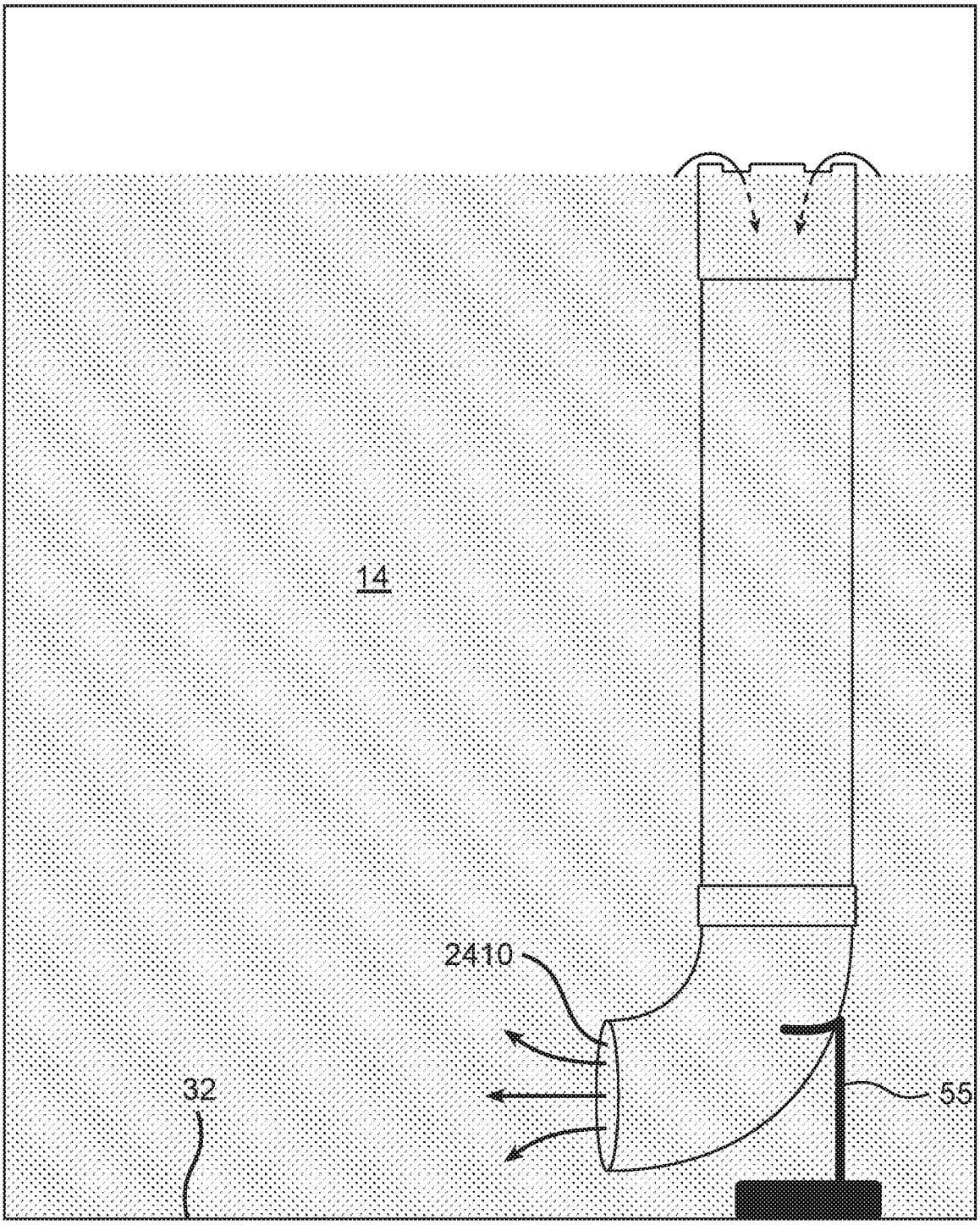
FIG. 7 schematically shows the filter of FIGS. 5 and 6 located in a body of water of a mikvah.

Attention is drawn to FIG. 7 illustrating the flow of water entering the filter via its upper edge 2210 and then released back into the water of the mikvah via its lower open end 2410. Also shown in this figure is attachment of the filter here at its bottom pipe 240 to floor 32 via a possible support 55, which maintains the filter fixed in place within the water of the mikvah. Such fixing (as aforementioned) may be in a non-permanent manner.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Further more, while the present application or technology has been illustrated and described in detail in the drawings and foregoing description, such illustration and description are to be considered illustrative or exemplary and non-restrictive; the technology is thus not limited to the disclosed embodiments. Variations to the disclosed embodiments can be understood and effected by those skilled in the art and practicing the claimed technology, from a study of the drawings, the technology, and the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures can not be used to advantage.

The present technology is also understood to encompass the exact terms, features, numerical values or ranges etc., if in here such terms, features, numerical values or ranges etc. are referred to in connection with terms such as "about, ca., substantially, generally, at least" etc. In other words, "about 3" shall also comprise "3" or "substantially perpendicular" shall also comprise "perpendicular". Any reference signs in the claims should not be considered as limiting the scope.

Although the present embodiments have been described to a certain degree of particularity, it should be understood that various alterations and modifications could be made without departing from the scope of the invention as hereinafter claimed.

The invention claimed is:

1. A sanitation device for cleaning a body of water in an immersion pool of a mikvah, the device comprising:

a hollow member extending along an axis X that in an operative position for cleaning is arranged to extend at least partially immersed in the water and in an upright orientation;

an upper opening that in the operative position is flush with the upper surface of the water; and a propeller positioned to produce a downward flow through the hollow member that urges water to enter the device via the upper opening to be cleaned in the device and then released back into the body of water after flowing past the propeller, wherein a gap G is formed between an outer edge of the propeller and an inner face of a portion of the device housing the propeller, wherein gap G is equal to or greater than about 25 millimeters.

2. The sanitation device of claim 1, wherein the upper opening is embodied by a top float that is axially slidable with respect to the hollow member, the top float having a buoyancy for maintaining the upper opening flush with the upper surface of the water.

3. The sanitation device of claim 2, wherein the upper opening being held flush with the upper surface of the water is achieved at least in part by:

the top float formed of a material that is lighter than materials in remaining portions of the device; and/or a peripheral channel beneath the upper opening that contains air during use of the device.

4. The sanitation device of claim 3, further comprising:

a disposable non-woven filter media through which water flows after entering the device.

5. The sanitation device of claim 1, wherein the device is detachably fixed in place in its operative position so that it can be manually lifted away from its position without obstruction.

6. The sanitation device of claim 5, wherein a lowermost end of the device is closer to the upper surface of the water in the immersion pool than to a floor of the mikvah's immersion pool.

7. The sanitation device of claim 6 further comprising an axially extending filter cartridge extending along at least a portion of the hollow member.

8. The sanitation device of claim 7, wherein the propeller is located below the filter cartridge.

9. The sanitation device of claim 1, wherein the propeller is powered by a brushless motor that is fitted directly thereto and submerged within the water in the operative position of the device.

10. The sanitation device of claim 9, wherein the device receives power from an electronic speed control (ESC).

11. The sanitation device of claim 10, wherein the ESC controls and regulates the speed of the electric motor powering the propeller.

12. A method for cleaning a body of water in an immersion pool of a mikvah, the method comprising the steps of:

providing a sanitation device having an upper opening, a lower propeller, and a filter media therebetween;

submerging the sanitation device within the immersion pool to position the upper opening of the device flush with the upper surface of the water in the immersion pool; and revolving the propeller to form a downward flow of water through the device that urges water from the upper surface of the immersion pool to flow into the device past the upper opening of the device, wherein a gap G is formed between an outer edge of the revolving propeller and an inner face of a portion of the device housing the propeller, wherein gap G is equal to or greater than about 25 millimeters.

13. The method of claim 12, wherein water flowing past the upper opening of the device is urged to flow downwards past the filter media and the propeller to exit the device at a position downstream of the propeller.

14. The method of claim 1, wherein the sanitation device filters out of the water passing therethrough floating substances from the upper surface of the water.

15. The method of claim 14, wherein the sanitation device functions in conjunction with one or more additional systems for treating the water in the mikvah.

16. The method of claim 15, wherein such additional system(s) contribute to formation of floating substances on the upper surface of the water.

17. The method of claim 16, wherein the sanitation device is located distantly to an ejection port of the additional system(s) in the immersion pool of the mikvah.

18. The method of any one claim 17, wherein the device and/or additional system(s) clean the water at times when users do not immerse in the immersion pool of the mikvah.

19. A skimmer for cleaning a body of water in an immersion pool of a mikvah, the skimmer comprising:

a main segment that in an operative position of the skimmer for skimming the water is arranged to axially extend at least partially immersed in the water and in an upright orientation;

a top segment that is fitted to an upper region of the main segment; and at least one flotation member coupled to the main segment for maintaining a rough flotation position of the skimmer, and the top segment in the operative position of the skimmer being axially movable relative to the main segment and having a buoyancy keeping an upper opening of the top segment either flush with the upper surface of the water or above the surface, wherein the main and top segments are hollow, and the skimmer further comprising;

a propeller to form a downward flow through the skimmer's main segment that urges water to enter the skimmer via the upper opening of the top segment in order to be cleaned in the skimmer and then be released back into the body of water after flowing past the propeller, and wherein a gap G is formed between an outer edge of the revolving propeller and an inner face of a portion of the skimmer housing the propeller, wherein gap G is equal to or greater than about 25 millimeters.

20. The skimmer of claim 10, wherein the upper opening of the top segment being held flush with the upper surface of the water is achieved by:

the top segment formed of a material that is lighter than materials in the skimmer's main segment; and/or a peripheral channel in the top segment beneath the upper opening that contains air during use of the skimmer.

* * * * *